US007607487B2

(12) United States Patent
Lucas et al.

(10) Patent No.: US 7,607,487 B2
(45) Date of Patent: Oct. 27, 2009

(54) PACKERS AND METHODS OF USE

(75) Inventors: Chad Lucas, Missouri City, TX (US); Oscar Rodriguez, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 204 days.

(21) Appl. No.: 11/213,364

(22) Filed: Aug. 26, 2005

(65) Prior Publication Data

US 2006/0180319 A1 Aug. 17, 2006

Related U.S. Application Data

(60) Provisional application No. 60/652,805, filed on Feb. 14, 2005.

(51) Int. Cl.
*E21B 33/12* (2006.01)
*E21B 34/12* (2006.01)
*E21B 23/06* (2006.01)

(52) U.S. Cl. ..... 166/387; 166/134; 166/131; 166/184; 166/331

(58) Field of Classification Search ..... 166/387, 166/126, 131, 133, 138, 142, 149, 150, 152, 166/184, 185, 188, 331, 77.2, 145, 118, 136
See application file for complete search history.

(56) References Cited

U.S. PATENT DOCUMENTS 2,164,195 A * 6/1939 Waltermire ..... 73/40.5 R
2,292,345 A * 8/1942 Armais ..... 166/131
2,327,610 A * 8/1943 Savitz ..... 166/264
3,065,796 A * 11/1962 Nutter ..... 166/331
3,433,301 A * 3/1969 McEver, Jr. ..... 166/128
3,519,075 A * 7/1970 Mullins ..... 166/150
4,103,741 A * 8/1978 Daigle ..... 166/147
4,532,989 A * 8/1985 Barker ..... 166/188
5,271,461 A * 12/1993 Decker et al. ..... 166/185
6,394,184 B2 5/2002 Tolman et al. ..... 166/281
6,474,419 B2 * 11/2002 Maier et al. ..... 166/387
6,520,255 B2 2/2003 Tolman et al. ..... 166/281

* cited by examiner

*Primary Examiner*—Kenneth Thompson
(74) *Attorney, Agent, or Firm*—Michael Flynn; David Cate; Robin Nava

(57) ABSTRACT

Packers and methods of using same are described. The packer includes a packer body, a slip to engage a casing of the well and a sealing element to seal an annulus of the well, a fluid bypass chamber adapted to allow fluid passage through the packer body during run in hole and in release position, and a re-settable mandrel slideably engaged with guide pins attached to the packer body and adapted to selectively open and close circulation paths upon actuation. This abstract allows a searcher or other reader to quickly ascertain the subject matter of the disclosure. It will not be used to interpret or limit the scope or meaning of the claims. 37 CFR 1.72(b).

17 Claims, 5 Drawing Sheets

PACKERS AND METHODS OF USE

This non-provisional patent application claims priority to provisional application Ser. No. 60/652,805 field Feb. 14, 2005.

BACKGROUND OF THE INVENTION

1. Field of Invention

The present invention relates generally to the field of well bore packing tools (otherwise known as packers), and more specifically to packers deployed using coiled tubing and methods of using same in various oil and gas well operations.

2. Related Art

Packers and plugs are run to hydraulically isolate the sections above and below the packer and to provide a mechanical anchor to prevent the packer from sliding inside the wellbore. In coiled tubing completion applications, the packer also holds the coiled tubing string in place. Packers are set mechanically, hydraulically, or on wireline. The mechanical-set packer is set by applying either tension or compression on the packer. The hydraulic-set packer is activated by hydraulic pressure. A packer forms a seal for purposes of controlling production, injection or treatment. The packer is lowered downhole into the well in an unset state. However, once in the appropriate position downhole, the packer is controlled from the surface of the well to set the packer. As an example, for a mechanically-set packer, a tubular string that extends from the surface to the packer may be moved pursuant to a predefined pattern to set the packer. In its set state, the packer anchors itself to the casing wall of the well and forms a seal in the annular region between the packer and the interior surface of the casing wall. This seal subdivides the annular region to form an upper annular region above the packer that is sealed off from a lower annular region below the packer. The packer typically includes at least one seal assembly to form the annulus seal and at least one set of slips to anchor the packer to the casing string. When run into the well, the seal assembly and the slips are radially retracted to allow passage of the packer through the central passageway of the casing string. After a particular job is complete, the slips and seals are again retracted, allowing the packer to be removed or moved to another location in the well.

Mechanically-set packers currently in use suffer from certain inadequacies. One problem is the inability, after annular fracturing, to cleanup sand and other debris that fall out directly on top of the packer. Fall out may occur when multiple perforation sets are present above the packer. For example, if the proppant fracture from the current zone were to grow vertically and/or poor quality cement is present behind the casing, the fracture could intersect the perforation sets above the packer seal such that proppant could "dump" back into the wellbore on top of the packer and prevent or obstruct further upward movement of the packer. Also, it could be difficult to execute circulation operations if multiple perforation sets are open above the packer. For example, if the circulation pressures exceed the breakdown pressures associated with the perforations open above the packer, the circulation may not be maintained with circulation fluid unintentionally lost to the formation. This may result in a higher probability of sticking the packer in the well.

Thus, there is a continuing need for packers and methods that address one or more of the problems that are set forth above.

SUMMARY OF THE INVENTION

In accordance with the present invention, packers and methods of use are described that reduce or overcome problems in previously known packers and methods.

A first aspect of the invention are packers useable with a subterranean well, comprising:

(a) a packer body, a slip to engage a casing of the well and a sealing element to seal an annulus of the well;

(b) the body comprising a fluid bypass chamber adapted to allow fluid passage through the packer body during run in hole and in release position; and (c) a re-settable mandrel slideably engaged with guide pins attached to the packer body and adapted to selectively open and close the fluid bypass chamber upon non-rotational motion of the packer body.

Apparatus of the invention include those apparatus that are compression set, and may comprise a straight pull release mechanism, as well as a connector for connecting the packer body to coiled tubing or jointed pipe. The inventive apparatus may employ one or more ported subs to allow equalization between the tubing and annulus during run in hole and release.

Inventive apparatus may further include those wherein the mandrel is adapted to be free-spinning and auto-indexing between settings, as well as apparatus wherein the mandrel has a 'J' profile for setting via coiled tubing or jointed pipe without substantial rotation of the coiled tubing or jointed pipe. Apparatus of the invention may include integral circulation ports in the packer body above the sealing element to enable cleaning or at least disturbance of debris that accumulates above the packer sealing element.

Another aspect of the invention are methods of using the inventive packer, one method of the invention comprising:

(a) running a packer to depth in a well bore on coiled tubing or jointed pipe;

(b) equalizing pressure between an annulus and the coiled tubing or the jointed pipe during running the packer to depth;

(c) mechanically setting the packer in the well bore without substantial rotation of the coiled tubing or jointed pipe; and (d) disturbing debris above a packer sealing element by indexing the packer without substantial rotation of the coiled tubing or jointed pipe.

Methods of the invention include those comprising wherein the mechanically setting and indexing the packer employs a mandrel attached to the packer, wherein the mandrel may be a free-spinning mandrel, and wherein the mandrel may be auto-indexing and have a J profile. Other methods of the invention are those including bypassing fluid through the packer to allow direct fluid passage below a packer primary seal during the running of the packer to depth and in release position, and wherein the disturbing of debris comprises circulating a fluid above the packer sealing element using one or more circulation ports integral with a packer body above the sealing element. Certain embodiments of the methods of using the inventive packer may include cleaning or at least disturbing debris behind the packer using one or more circulation subs integral with a packer body and below the sealing element of the packer.

Apparatus and methods of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which.

Figure 1A:
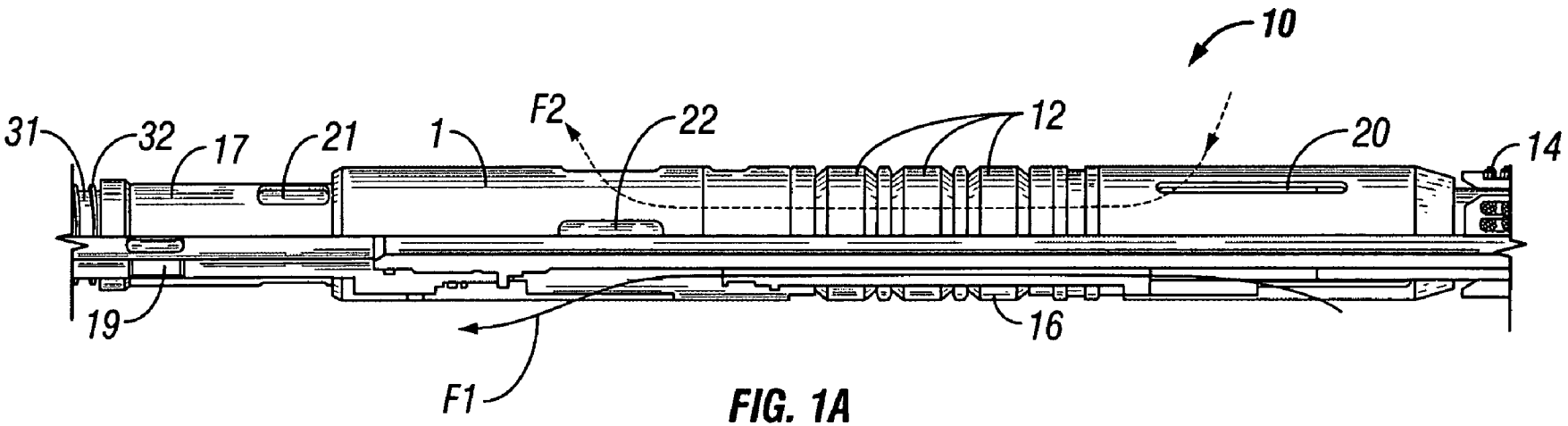
FIGS. 1A and 1B are schematic partial cross-sectional views of a top and a bottom portion, respectively, of a packer in accordance with the invention in run in hole mode.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes packers and methods of using same. A "wellbore" may be any type of well, including, but not limited to, a producing well, a non-producing well, an experimental well, and exploratory well, and the like. Wellbores may be vertical, horizontal, some angle between vertical and horizontal, diverted or non-diverted, and combinations thereof, for example a vertical well with a non-vertical component. Mechanically-set packers currently in use suffer from certain inadequacies. One problem is the inability, after annular fracturing, to cleanup sand and other debris that fall out directly on top of the packer. Fall out may occur when multiple perforation sets are present above the packer. For example, if the proppant fracture from the current zone were to grow vertically and/or poor quality cement is present behind the casing, the fracture could intersect the perforation sets above the packer seal such that proppant could "dump" back into the wellbore on top of the packer and prevent or obstruct further upward movement of the packer. Also, it could be difficult to execute circulation operations if multiple perforation sets are open above the packer. For example, if the circulation pressures exceed the breakdown pressures associated with the perforations open above the packer, the circulation may not be maintained with circulation fluid unintentionally lost to the formation. This may result in a higher probability of sticking the packer in the well. Thus, there is a continuing need for packers and methods that address one or more of the problems that are set forth above.

Given that safety is a primary concern, and that there is considerable investment in existing equipment, it would be an advance in the art if existing packers could be modified and/or improved to increase safety and efficiency during wellbore operations, with minimal interruption of other well operations. This invention offers methods and apparatus for these purposes.

Figure 1B:
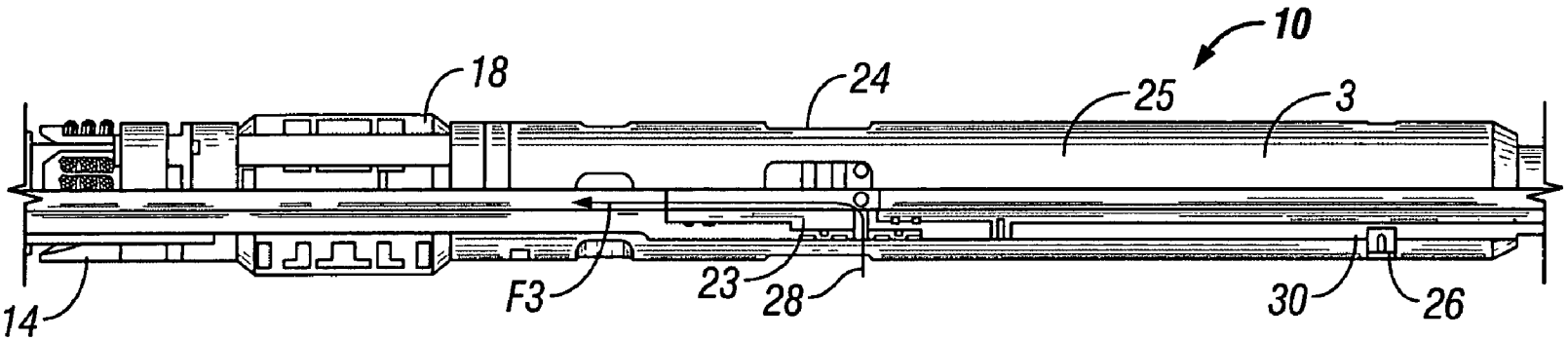

Referring now to the figures, FIGS. 1A and 1B illustrate schematically, and not to scale, partial cross-sectional views of a top portion and a bottom portion of a packer 10 of the invention. Illustrated in FIG. 1A is a packer body top portion 1, and in FIG. 1B a packer bottom body portion 3, joined together by a flexible connector 18. A seal assembly having three seal elements 12 and one or more slips 14 are shown as well. Seal elements 12 and slips 14 are in pre-set position, i.e., they are not extended out toward the wellbore casing (not shown) as they would be in use to seal an annulus. Packer body portions 1 and 3 define an inner conduit 16. A circulating sleeve 17 slides over a circulating sub 31 during various stages of operation. A spring 32 keeps the circulating sleeve 17 biased downward during operations. Circulation Sleeve 17 has one or more passages 21 whose use will become apparent. Also illustrated is a circulation port 19, as well as a pair of slots 20 adapted to allow fluid to enter and exit as required, as further explained herein. Fluid bypass openings 22 allow fluid to travel in the direction of arrows F1 and F2 through flow slots 20, inner conduit 16, and out through fluid bypass openings 22 during run in hole. FIG. 1B illustrates a pair of secondary circulation openings 24 in an outer mandrel sleeve 25 of lower packer body 3, and a corresponding secondary circulation port (sometimes referred to herein as a ported sub) 28 in a coupling 23, allowing fluid to flow as depicted by arrow F3 during run in hole. FIG. 1B also illustrates a position of a cycle mandrel 30 and guide or setting pin 26, it being understood that more than one guide pin may be used. Guide pins 26 are attached to cycle mandrel 30 and guide cycle mandrel 30 moving axially (right to left in the figures) through guide slots 27 in cycle mandrel 30, as is more clearly illustrated in FIGS. 4A and 4B. In the run in hole position shown in FIG. 1A, note that circulation port 19 is closed off by circulating sleeve 17.

Figure 2A:
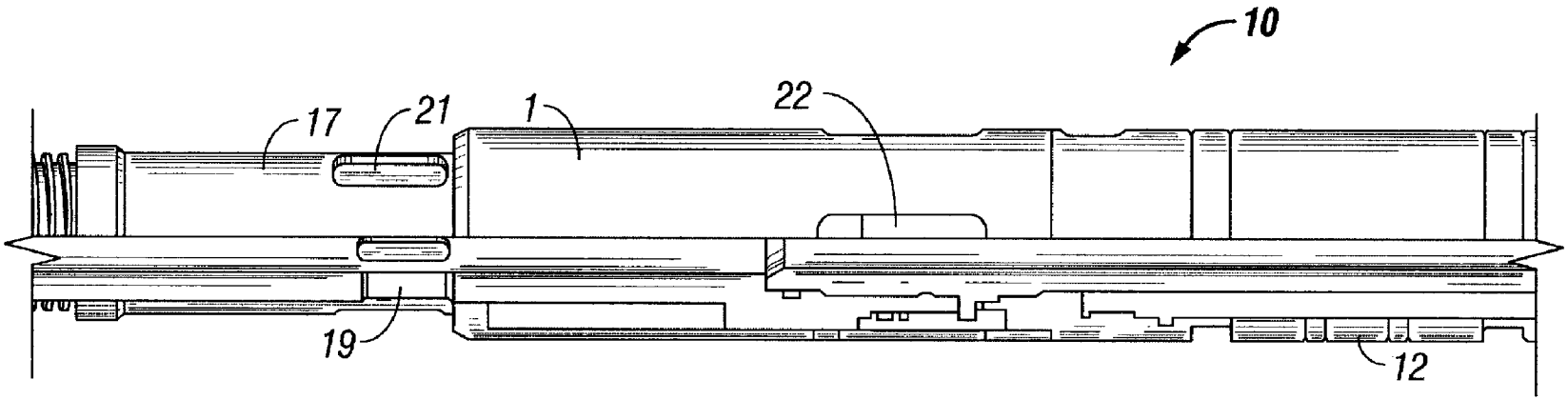
FIGS. 2A and 2B are schematic partial cross-sectional views of the packer of FIGS. 1A and 1B in set mode.
Figure 2B:
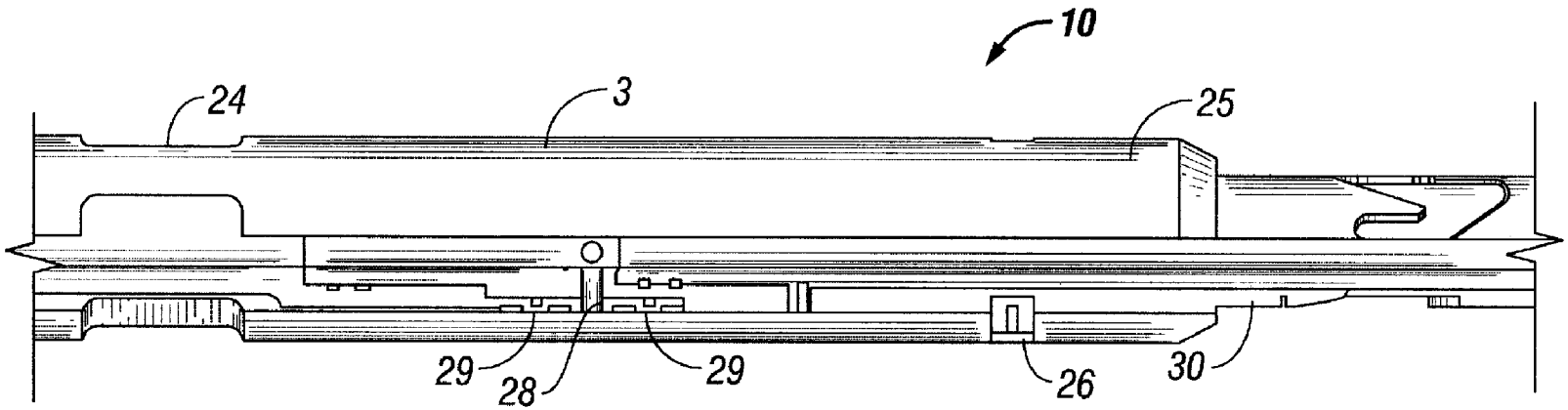
Figure 5:
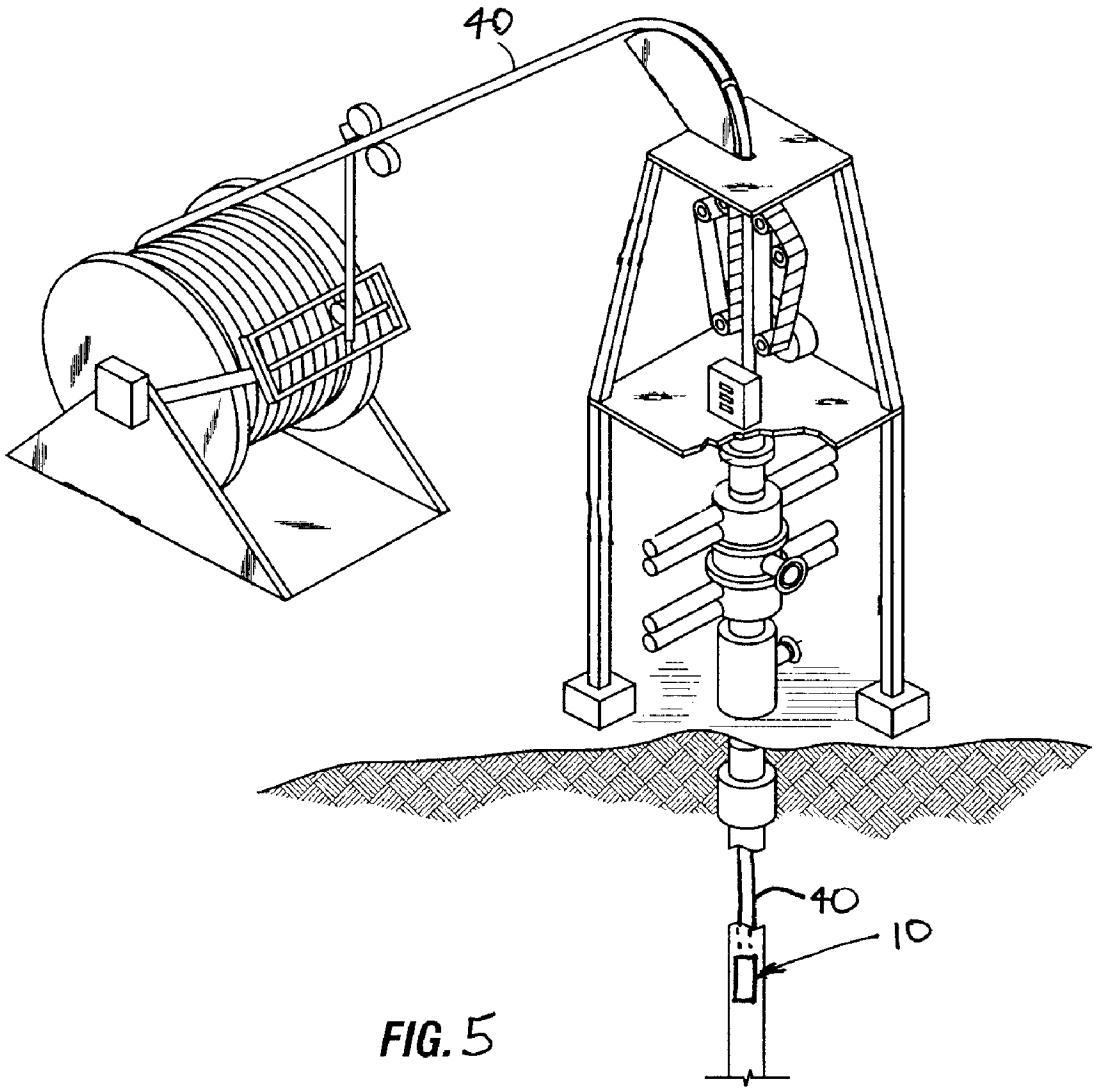
FIG. 5 is a schematic perspective view of a packer in accordance with the invention shown attached to coiled tubing.

FIGS. 2A and 2B illustrate schematically the top 1 and bottom 3 portions, respectively, of the packer 10 of FIGS. 1A and 1B, but in set mode. The same numerals are used throughout the drawing figures for the same parts unless otherwise indicated. Packer 10 may be indexed using coiled tubing, such as coiled tubing 40 shown in FIG. 5, or jointed pipe connected to packer 10. Simple lifting and setting back down of packer 10 using top-side equipment (not illustrated) is typically all that is required, unless some cleanout must be performed to loosen debris, as further discussed herein. Importantly, it is not necessary to twist or rotate the coiled tubing 40 or jointed pipe in order to operate, or "index", packer 10 using cycle mandrel 30. Illustrated in FIG. 2A are seal elements 12 in expanded mode, pressing against the well casing (not illustrated). Fluid bypass openings 22 are now closed in top portion 1 of packer 10, as well as secondary circulation ports 28 (FIG. 2B) by virtue of ports 28 moving away from secondary circulation openings 24 and outer mandrel 25 moving upward (to the left in FIG. 2B, guided by guide pin 26) into a seal bore in the outer mandrel 25. Seals 29 on both sides of the secondary circulation ports now close off the secondary circulation ports flow paths. Circulation port 19 is now open as it is lined up with passage 21. In this set position, once the operation is complete, fluid may be directed through coiled tubing or jointed pipe, through circulation port 19 and passage 21, thereby allowing any debris to be disturbed or removed and decrease the probability of packer 10 becoming stuck in the wellbore.

There are many varieties of mandrels. Any type of J-slot mandrel may be used and their foreseeable functional equivalents and considered within the invention.

Figure 3A:
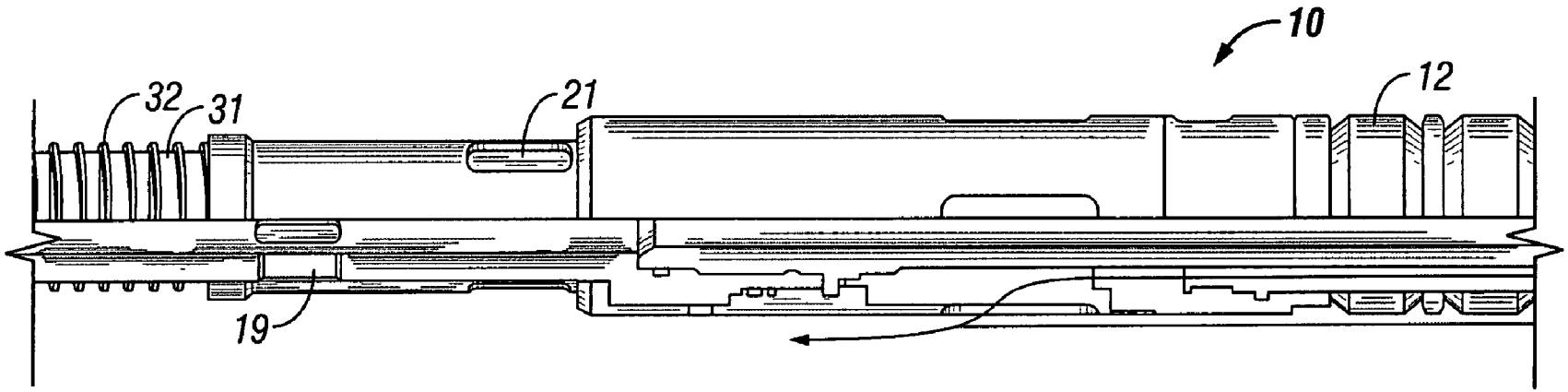
FIGS. 3A and 3B are schematic partial cross-sectional views of the packer of FIGS. 1*a* and 1B in the release mode.
Figure 3B:
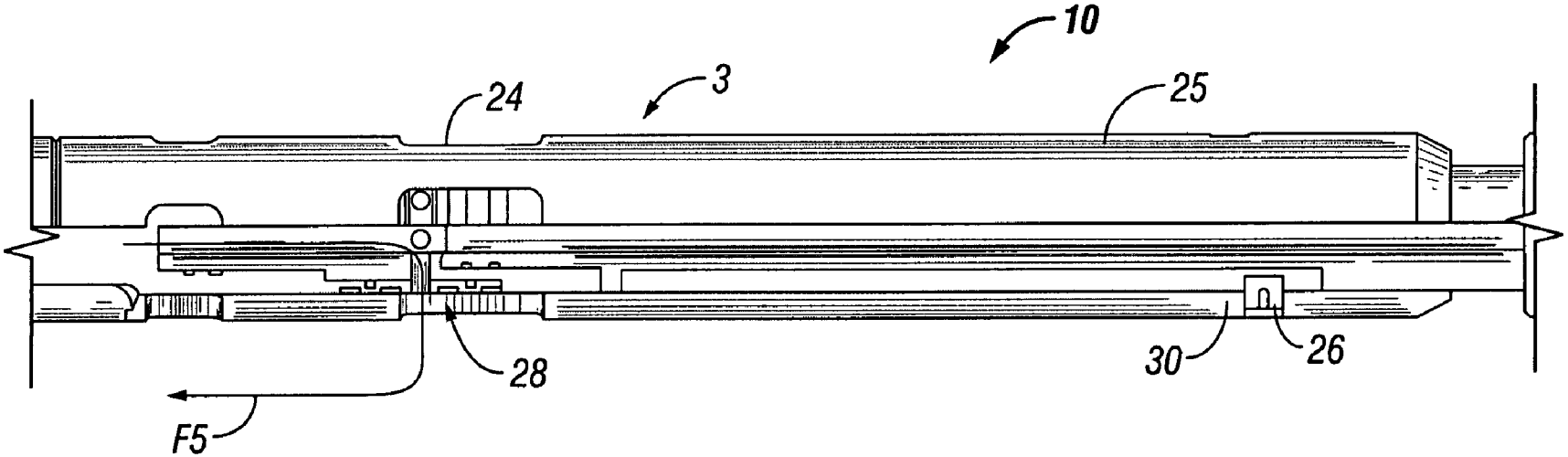

FIGS. 3A and 3B are similar to FIGS. 1A and 1B but illustrate schematically packer 10 in release position. Note that cycle mandrel 30 is completely protected by outer mandrel 25 in release position. This helps to prevent guides 27 in inner mandrel 30 from becoming clogged with debris or otherwise damaged as the packer is removed from the wellbore, or moved to another position in the same wellbore. Circulation port 19 is no longer aligned with passage 21, so there is no fluid flow at the top of the packer. However, note that fluid may traverse through packer bottom portion 3 through secondary circulation openings 24 and secondary flow ports 28 as indicated by arrow F5. This conveniently allows the operator to disturb debris below sealing elements 12, if need be, in order to remove packer 10 or re-position it in another part of the wellbore.

Figure 4A:
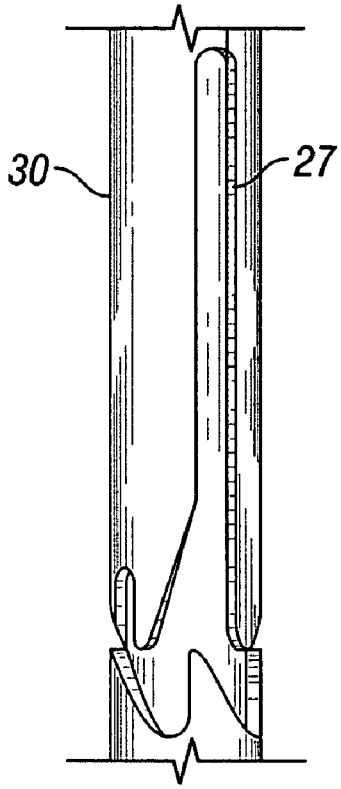
FIG. 4 is a schematic view of a J mandrel useful in the invention.
Figure 4B:
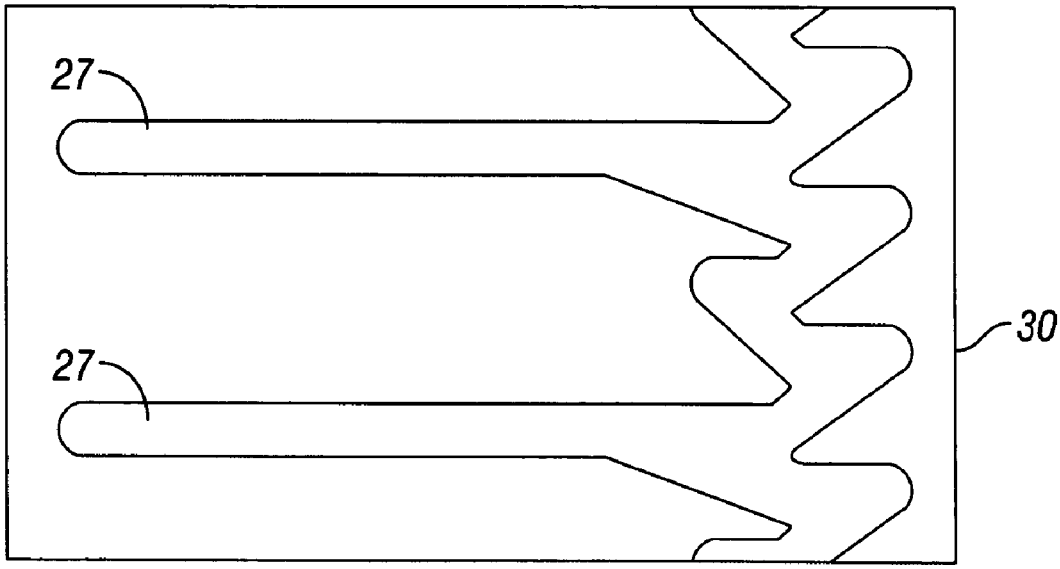

FIGS. 4A and 4B are schematic views of an inner J mandrel useful in the invention, it again being worth stating that other shaped mandrels that will perform the functions discussed herein will suffice equally as well, and are considered within the invention. FIG. 4A illustrates cycle mandrel 30 in side elevation, clearly showing guide slots 27 for guide pins (the guide pins are not shown in this figure). FIG. 4B illustrates how one or more guide pins 26, attached to an outer mandrel (not shown in this figure) would slide within guide slots 27 upon alternate lifting and re-setting of the packer. Guide pins 26 would be in "Position 1:RIH", which means "run in hole", for the portion of the methods when the packers are run into the wellbore. A second position, indicated as "Position 2: Pick Up", indicates where guide pins 26 would move or index to upon pick up (tension) in the coiled tubing or jointed pipe attached to the packer. To set the packer, coiled tubing or jointed pipe is pushed generally downward into the wellbore (compression set), and guide pins 26 are forced up into guide slots 27. The final position is "Position 4: Release", which actually indexes the mandrel back to a position similar to position 2, pick up. Compression force applied subsequent to position 4 results in guide pins 26 moving back in to position 1, run in hole.

In use, for example in annular frac cleanup, packer 10 thus utilizes hold down slips 14 to anchor it against the casing, when a low compressive load is applied to the coiled tubing or jointed pipe string. Once the slips are anchored into the casing, the primary seal elements 12 are compressed and packed off against the casing ID, the ported sub 28 is closed off and the primary circulation ports 19, above the packer, are opened for annular frac cleanup. Although some rotation is not excluded, only up/down coiled tubing/jointed pipe manipulation should be required to activate the setting mechanism. The inventive packers use a conventional drag block system to provide external component resistance. This resistance allows for relative movement between internal and external components of the packers, thus allowing the tool to index through the setting sequence.

A representative method of the invention, including a setting sequence (system responses) of the invention, using coiled tubing (CT) and a packer of the invention, may be as follows:

The packer is run to depth on the CT. The setting cycle mandrel is in the first position at this stage. Fluid bypass feature is open, thus reducing the swabbing tendency of the primary seal. The ported sub is opened below the sealing elements allowing communication between the CT and the annulus, for tubing fill.

Once on depth, the CT is picked up. This action indexes the cycle mandrel into its second position. Fluid bypass feature is still open. The ported sub is stroked upward, however remains opened.

The CT is then slacked off and compressive load is applied (due to the weight of CT). This indexes the cycle mandrel into its third position in the setting sequence. The slips and the primary seal elements are set from this position. The bypass seal is closed, thus isolating the flow path below the sealing element. The ported sub below the packer sealing elements is closed, thus isolating the tubing from the lower annulus. The primary circulation ports above the sealing elements are opened, allowing direct communication between the tubing and upper annulus.

An annular frac job is then performed. Once complete, the excess proppant and any debris present are then circulated out of the annulus through the primary circulation ports, directly above the sealing elements.

Once clean up of the annulus is achieved, the CT is picked up and the internal components of the packer are stroked into the release position. This indexes the cycle mandrel into the fourth position. The bypass seal is re-opened, allowing flow from above the sealing elements to below. The primary circulation ports, above the packer sealing elements, are again blanked off. The ported sub below the packer sealing elements is again re-opened. It is now possible to circulate down the CT and exit fluid out below the packer's primary seal; this allows the operator the unique ability to "wash" up the backside of the packer's sealing elements. This fluid flow path will aid in "lifting" or re-suspending sand or other debris that has been packed or settled out just above the sealing elements.

Continued upward movement of the CT will raise the packer up the well bore and into the next zone. Once the packer is in the correct location for the next interval, the CT can be slacked off. The compressive load generated during this slack off will index the cycle mandrel back into the first position or "run in hole" position.) The setting sequence can be repeated from this point forward.

In summary, the inventive packers have one or more of the following unique, patentable features:

Integral circulating ports above the sealing element: this circulation feature is strategically placed on the packer to minimize the distance between the circulation (clean up) ports and the primary seal elements. These circulating ports aid in the removal of proppant/debris from the top of the primary seal.

In the packer's released position, the circulating ports (above) are closed off and an additional circulation sub below the packer is opened. With the lower ports opened, flow can now be established down the ID and allowed to exit below the packer. By exiting fluid below the packer and flowing up the annulus, the fluid flow can be used to remove or re-suspend proppant/debris from the backside of the packer seal elements.

The cycle mandrel is the internal setting component of the packer. The cycle mandrel uses a free-spinning, auto "J" profile. This component allows the packer to run in hole, set, release, and reset with up/down tubing manipulation only, or with minimal rotation of tubing. As the packer moves through the different positions on the cycle mandrel, the cycle mandrel will free spin relative to the internal and external components. Alternatively, the cycle mandrel also allows for a secondary setting contingency. If for some reason the cycle mandrel becomes bound and cannot spin, then the outer components will still have the ability to rotate relative to the cycle mandrel, thus indexing into the required positions. This may be accomplished when the up/downward movement of the internal string imparts a torsion load between the cycle mandrel, indexing pins, and outer components. This torsion load only has to overcome the static friction resistance of the drag block assembly; once this threshold is achieved the outer components can then rotate relative to the internal string.

The cycle mandrel also provide the ability of the inventive packers to move down hole once released. Traditional compression set, non-rotational packers do not offer this ability to move down once released. This movement will traditionally try to re-set the tools. If debris above the primary sealing elements limits upward movement in the release position, then downward movement can be applied thus indexing the cycle mandrel back into the run-in-hole position. From this position the inventive packers may be pushed free from the debris barrier.

Packers of the invention require very low compressive setting load, typical with CT applications. The low setting load creates an initial low-pressure seal against the casing. Once the low-pressure seal is established, the packer then utilizes the available low differential pressure to continue applying pack-off load into the primary sealing elements. As the differential pressure is increased, so does the pack-off load into the primary sealing elements.

An optional feature of packers of the invention is one or more sensors located at the tool to detect the presence of hydrocarbons (or other chemicals of interest) in the fluid traversing up CT main passage 16 during a CT or jointed tubing operation. The chemical indicator may communicate its signal to the surface over a fiber optic line, wire line, wireless transmission, and the like. When a certain chemical is detected that would present a safety hazard if allowed to reach surface (such as oil or gas), the packer may be indexed to a safe position, long before the chemical creates a problem.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. A packer useable with a subterranean well, comprising:

(a) a packer body, a slip to engage a casing of the well and a sealing element to seal an annulus of the well;

(b) the body comprising a fluid bypass chamber adapted to allow fluid passage through the packer body during run in hole and in release position;

(c) a re-settable mandrel slideably engaged with guide pins attached to the packer body and adapted to selectively open and close the fluid bypass chamber upon actuation, wherein the mandrel is adapted to be free-spinning and auto-indexing between settings; and (d) a circulating sleeve attached above the body and adapted to direct fluid above the packer body during at least a set position.

2. The packer of claim 1 which is compression set.

3. The packer of claim 1 comprising a straight pull release mechanism.

4. The packer of claim 1 comprising a ported sub to allow equalization between the tubing and annulus during run in hole and release.

5. The packer of claim 1 wherein the mandrel has a 'J' profile for indexing the packer via coiled tubing or jointed pipe without substantial rotation of the coiled tubing or jointed pipe.

6. The packer of claim 1 comprising integral circulation ports in the body above the sealing element, the circulation ports covered or uncovered by the circulating sleeve.

7. The packer of claim 1 comprising a circulation sub in the body below the sealing element.

8. The packer of claim 1 wherein the packer is run into the well on coiled tubing.

9. The packer of claim 1 further comprising a spring biasing the circulating sleeve toward the packer body.

10. A packer for use in a subterranean well, comprising:

(a) a packer having a packer body, a slip to engage a casing of the well and a sealing element to seal an annulus of the well, the packer being re-settable, compression set, and straight pull release;

(b) the body comprising a fluid bypass chamber adapted to allow fluid passage through the packer body during run in hole and in release position;

(c) a connector for connecting the packer body to coiled tubing or jointed pipe;

(d) a ported sub integral with the packer body and below the sealing element;

(e) a circulating sleeve operable to cover and uncover one or more circulation ports integral with the packer body and above the sealing element; and (f) a re-settable, auto-indexing 'J' profile mandrel for compression-setting the packer via coiled tubing or jointed pipe without substantial rotation of the coiled tubing or jointed pipe, wherein the mandrel is free-spinning relative to internal and external components of the packer.

11. The packer of claim 10 further comprising a spring biasing the circulating sleeve toward the packer body.

12. A method of using a packer, comprising:

(a) running a packer to depth in a well bore on coiled tubing or jointed pipe;

(b) equalizing pressure between an annulus and the coiled tubing or the jointed pipe during running the packer to depth;

(c) mechanically setting the packer in the well bore employing a mandrel attached to the packer without substantial rotation of the coiled tubing or jointed pipe, wherein the mandrel is free-spinning relative to internal and external components of the packer; and (d) disturbing debris above the packer by allowing for multiple circulation paths depending on packer position, wherein disturbing comprises circulating a fluid above the packer by uncovering, with a circulating sleeve, one or more circulation ports integral with a packer body and above a sealing element of the packer.

13. The method of claim 12 wherein the mandrel is auto indexing.

14. The method of claim 12 wherein the mandrel has a 'J' profile.

15. The method of claim 12 comprising bypassing fluid through the packer during the running of the packer to depth and in release position.

16. The method of claim 12 comprising disturbing debris behind the packer using one or more circulation subs integral with a packer body and below a sealing element of the packer.

17. The method of claim 12 further comprising a spring biasing the circulating sleeve toward the packer body.

* * * * *